US007926880B2

(12) United States Patent
Heidmann et al.

(10) Patent No.: US 7,926,880 B2
(45) Date of Patent: Apr. 19, 2011

(54) SEAT SUSPENSION AND METHOD OF MANUFACTURE

(75) Inventors: Kurt R. Heidmann, Grand Rapids, MI (US); Gordon J. Peterson, Rockford, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 12/694,970

(22) Filed: Jan. 27, 2010

(65) Prior Publication Data

US 2010/0127551 A1 May 27, 2010

Related U.S. Application Data

(63) Continuation of application No. 11/741,329, filed on Apr. 27, 2007, now abandoned.

(60) Provisional application No. 60/796,087, filed on Apr. 28, 2006.

(51) Int. Cl.
*A47C 7/02* (2006.01)

(52) U.S. Cl. ..... 297/452.63; 297/452.21

(58) Field of Classification Search ..... 297/452.63, 297/452.15, 452.21, 452.18
See application file for complete search history.

(56) References Cited

U.S. PATENT DOCUMENTS

| | | | | |
|---|---|---|---|---|
| 0,025,569 | A | | 9/1859 | Howe |
| 0,160,809 | A | | 3/1875 | Bennett |
| 0,172,401 | A | | 1/1876 | Durant |
| 0,242,633 | A | | 6/1881 | Guerrant |
| 0,389,292 | A | | 9/1888 | Flohr |
| 508,517 | A | * | 11/1893 | Harrison ..... 5/238 |
| 1,513,726 | A | | 10/1924 | Lamplugh |
| 2,227,685 | A | | 1/1941 | Williams et al. |
| 2,316,628 | A | | 4/1943 | Schaffner |
| 2,803,293 | A | | 8/1957 | Rowland |
| 3,156,461 | A | | 11/1964 | Caughey |
| 3,527,499 | A | | 9/1970 | Rathbun et al. |
| 3,628,830 | A | | 12/1971 | Mitjans |
| 3,675,970 | A | | 7/1972 | Bereday |
| 3,709,559 | A | | 1/1973 | Rowland |
| 3,829,048 | A | | 8/1974 | Platt et al. |
| 3,840,269 | A | | 10/1974 | Ambrose |
| 3,842,452 | A | | 10/1974 | Kievits |
| 3,860,287 | A | | 1/1975 | Platt |
| 3,877,750 | A | | 4/1975 | Scholpp |

(Continued)

FOREIGN PATENT DOCUMENTS

BE 572539 11/1958

(Continued)

*Primary Examiner* — Sarah B McPartlin
(74) *Attorney, Agent, or Firm* — Price, Heneveld, Cooper DeWitt & Litton, LLP

(57) ABSTRACT

A seating construction includes a perimeter frame defining an open area, and a one-piece molded seating component supported on the frame. The seating component includes a plurality of integrally-formed flexible slats defining a support surface over the open area. Resilient wires are coupled to the slats to resiliently support the slats when flexed. The component can be handled as a unit for assembly, and is retained by connecting rods that extend along the side section of the frame, with the slats each rotatably engaging mating bearing structure on the frame. A flex-limiting member in a center of the frame limits the resilient supports to a maximum deflected condition. Tabs on the molded component interconnect the slats and permit one-piece molding, but are either flexible or breakable to permit independent flexing of the slats. Methods related to the above are also disclosed.

18 Claims, 9 Drawing Sheets

U.S. PATENT DOCUMENTS

| | | | |
|---|---|---|---|
| 3,990,742 | A | 11/1976 | Glass et al. |
| 4,060,280 | A | 11/1977 | Van Loo |
| 4,309,058 | A | 1/1982 | Barley |
| 4,415,147 | A | 11/1983 | Biscoe et al. |
| 4,463,465 | A | 8/1984 | Parker et al. |
| 4,545,614 | A | 10/1985 | Abu-Isa et al. |
| 4,582,361 | A | 4/1986 | Kennel |
| 4,696,516 | A | 9/1987 | Yeum |
| 4,722,821 | A | 2/1988 | Vermilye |
| 4,768,244 | A | 9/1988 | Riedl |
| 4,858,992 | A | 8/1989 | La Sota |
| 5,088,793 | A | 2/1992 | Mithuhiro |
| 5,106,157 | A | 4/1992 | Nagelkirk et al. |
| 5,283,918 | A | 2/1994 | Weingartner et al. |
| 5,368,368 | A | 11/1994 | Fukui et al. |
| 5,385,389 | A | 1/1995 | Bishai |
| 5,405,179 | A | 4/1995 | Jih |
| 5,462,339 | A | 10/1995 | Schmale et al. |
| 5,518,294 | A | 5/1996 | Ligon, Sr. et al. |
| 5,520,438 | A | 5/1996 | Stulik |
| 5,568,664 | A | 10/1996 | Lin |
| 5,624,161 | A | 4/1997 | Sorimachi et al. |
| 5,658,049 | A | 8/1997 | Adams et al. |
| 5,769,491 | A | 6/1998 | Schwarzbich |
| 5,884,977 | A | 3/1999 | Swamy et al. |
| 5,934,758 | A | 8/1999 | Ritch et al. |
| 6,056,367 | A | 5/2000 | Hsiao |
| 6,074,013 | A | 6/2000 | Hsiao |
| 6,099,075 | A | 8/2000 | Watkins |
| 6,116,694 | A | 9/2000 | Bullard |
| 6,134,729 | A | 10/2000 | Quintile et al. |
| 6,357,826 | B1 | 3/2002 | Gabas et al. |
| 6,357,830 | B1 | 3/2002 | Ratza et al. |
| 6,398,310 | B1 | 6/2002 | Seeliger |
| 6,550,859 | B1 | 4/2003 | Andersson et al. |
| 6,565,157 | B2 | 5/2003 | Barile, Jr. et al. |
| 6,601,919 | B1 | 8/2003 | Deceuninck |
| 6,820,933 | B2 | 11/2004 | Fereira Da Silva |
| 6,880,886 | B2 | 4/2005 | Bodnar et al. |
| 6,905,170 | B2 | 6/2005 | McMillen et al. |
| 6,932,430 | B2 | 8/2005 | Bedford et al. |
| 2003/0001424 | A1 | 1/2003 | Mundell et al. |
| 2004/0245839 | A1 | 12/2004 | Bodnar et al. |
| 2004/0245840 | A1 | 12/2004 | Tubergen et al. |
| 2004/0245841 | A1 | 12/2004 | Peterson et al. |
| 2005/0073183 | A1 | 4/2005 | Hsiao |
| 2005/0140199 | A1 | 6/2005 | Kang et al. |

FOREIGN PATENT DOCUMENTS

| | | |
|---|---|---|
| BE | 856830 | 10/1977 |
| DE | 834587 | 3/1952 |
| DE | 4232364 | 3/1994 |
| DE | 29805913 | 8/1998 |
| FR | 767099 | 7/1934 |
| FR | 883637 | 7/1943 |
| FR | 54852 | 12/1950 |
| FR | 1138818 | 6/1957 |
| FR | 1338211 | 11/1962 |
| GB | 149246 | 4/1921 |
| GB | 342613 | 2/1931 |
| GB | 483047 | 4/1938 |
| GB | 640883 | 8/1950 |
| GB | 1163263 | 9/1969 |

* cited by examiner

SEAT SUSPENSION AND METHOD OF MANUFACTURE

CROSS REFERENCE TO RELATED APPLICATIONS

This application is a continuation of U.S. patent application Ser. No. 11/741,329, filed on Apr. 27, 2007 now abandoned, entitled "SEAT SUSPENSION AND METHOD OF MANUFACTURE," which claims the benefit of U.S. Provisional Patent Application No. 60/796,087, filed on Apr. 28, 2006, entitled "SEAT SUSPENSION AND METHOD OF MANUFACTURE," the entire disclosures of which are incorporated herein by reference.

BACKGROUND

The present invention relates to seat suspensions and methods of manufacturing seat suspensions, though the present invention is not believed to be limited only to seats and seat suspensions.

Many modern chairs are highly adjustable and comfortable. However, as a result, they often include a large number of components that are complex to manufacture and/or difficult to assemble. This can lead to high manufacturing cost and/quality problems. Seating constructions are desired that provide optimal comfort and ergonomics, while being light in weight, relatively simple in design, and robust in operation. Further, it is desirable to use materials in a way that takes maximum advantage of their properties, but in integrated ways that do not require exotic solutions. Also, seating constructions are desired that are easier to assemble, and that include less components and more integrated solutions. Also, modern consumers are often concerned with environmental issues, and it is desirable to provide seating constructions that utilize environmentally friendly materials in constructions that can be readily disassembled for recycling.

Bodnar U.S. Pat. No. 6,880,886 discloses a chair of interest having flexible resilient wires positioned in a seat frame opening. Peterson publication US2004/0245841 A1 also discloses various configurations of interest. However, further improvements are desired, such as to minimize the number of parts, facilitate assembly, and improve overall operation and function, while providing a robust, durable assembled seating unit with recyclable components.

Thus, articles and methods having the aforementioned advantages and solving the aforementioned problems are desired.

SUMMARY OF THE PRESENT INVENTION

In one aspect of the present invention, a seating construction includes a frame defining an open area and having a plurality of discrete spaced-apart first structures positioned along opposite sides of the open area. A plurality of elongated flexible slats are extended across the frame over the open area, each slat including ends with second structures thereon. At least one of the first and second structures includes protruding portions that straddle a mating portion on the other of the first and second structures.

In another aspect of the present invention, a seating construction includes a seat frame with side frame sections defining an open area therebetween and having a plurality of discrete first structures spaced along each of the side frame sections adjacent the open area. A plurality of flexible slats are made of polymeric material and are operably supported over the open area. Each of the flexible slats have a range of deflection under normal load and further each have ends integrally formed with the polymeric material of the slats and defining second structures. The first and second structures include arcuate bearing surfaces that matably rotatingly engage.

In another aspect of the present invention, a seating construction includes a base frame, a seat frame with side sections supported on the base frame and defining an open area between the side sections; and a one-piece molded component. The molded component is made separate from the seat frame and is operably supported on the seat frame. The molded component includes a plurality of integrally-formed flexible slats interconnected by a plurality of deformable tabs. The slats include ends supported on the side sections and mechanically attached thereto so as to define a support surface over the open area with individual slats being configured to individually bend and deflect, with the tabs permitting material to flow between adjacent slats during molding to form the one-piece separately-molded component but being deformable to permit the slats to individually flex.

In another aspect of the present invention, a seating construction includes a seat frame defining an open area, a plurality of resilient supports supported on the seat frame and extending across the open area, each resilient support being configured to bend and flex to support a seated user over the open area, and a flex-limiting member positioned in the open area and shaped to engage the resilient supports to limit movement of individual ones of the resilient supports to a maximum deflected condition.

In another aspect of the present invention, a method of manufacturing a seating unit comprises steps of injection-molding a one-piece seat component adapted to provide seating support, including molding integrally formed slats interconnected by integrally formed tabs. The method further includes flexing the slats to deform the tabs.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
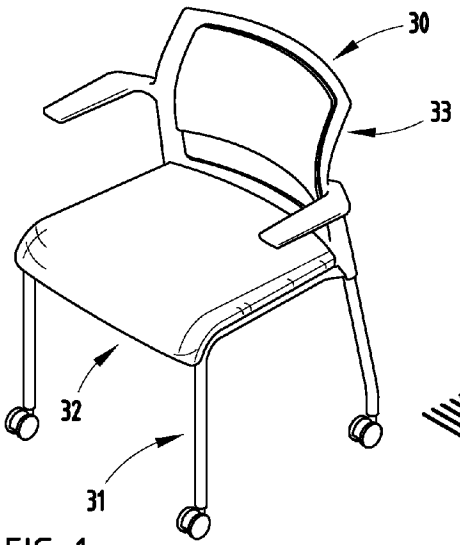
FIG. 1 is a perspective view of a seating unit embodying the present invention.

A seating unit 30 (FIGS. 1-2) includes a base 31, a seat suspension 32, and a back 33. Specifically, the base 31 includes a tubular base frame 34 defining four legs 35 (with castors or glides selectively attached to bottoms), a U-shaped horizontal seat-supporting frame member 36, and rear uprights 37. The back 33 is a molded component that includes a back panel 38 with armrests 41 or a back panel 38A (without arms). The back panels 38 and 38A have enlarged corner sections 39 with a hole therein for telescopingly engaging the uprights 37, and an enlarged horizontal beam section 40 for acting as a cross brace to stiffen a rear of the frame 34 when the back 33 is attached. The back 33 optionally includes a back cushion 42 with polymeric support panel 43 adhered by adhesive to the back panel 38.

The seat suspension 32 includes a pan-shaped molded seat frame 44, a one-piece molded component 45 defining a plurality of slats 46, resilient supports 47 attached to and resiliently supporting the slats 46 to define a comfort surface adapted to flexibly support a seated user, and an upholstered cushion 48. The subassembly of the component 45 and resilient supports 47 can be handled as a unit when placed on the molded frame 44 for assembly, thus assisting and simplifying assembly. Further, the resilient supports 47 (and the subassembly) are retained to the molded frame 44 by connecting rods 49 that extend along the side sections 50 of the molded frame 44. The slats 46 each include arcuate bearing surfaces 51 on each end that rotatably engage a mating bearing structure 52 on the molded frame 44 to define an axis of rotation aligned with the connecting rods 49. A flex-limiting member 53 (i.e. preferably a foam piece) positioned in a center of "pan-shaped" open area of the frame 44 limits the resilient supports 47 to a maximum deflected condition. Tabs 54 (FIG. 5) on the molded component 45 interconnect the slats 46 near the bearing surfaces 51 and permit molded component 45 to be one piece (i.e., the tabs 54 interconnect the slats 46). However, the illustrated tabs 54 are relatively short and "stubby," such that they break when the slats 46 are flexed to permit independent flexing movement of the slats 46. Alternatively, it is contemplated that the tabs will be designed to be flexible, such as by having an "S" shape or a thin profile, so that they permit flexure of the slats 46 without fracturing the tabs.

Figure 3:
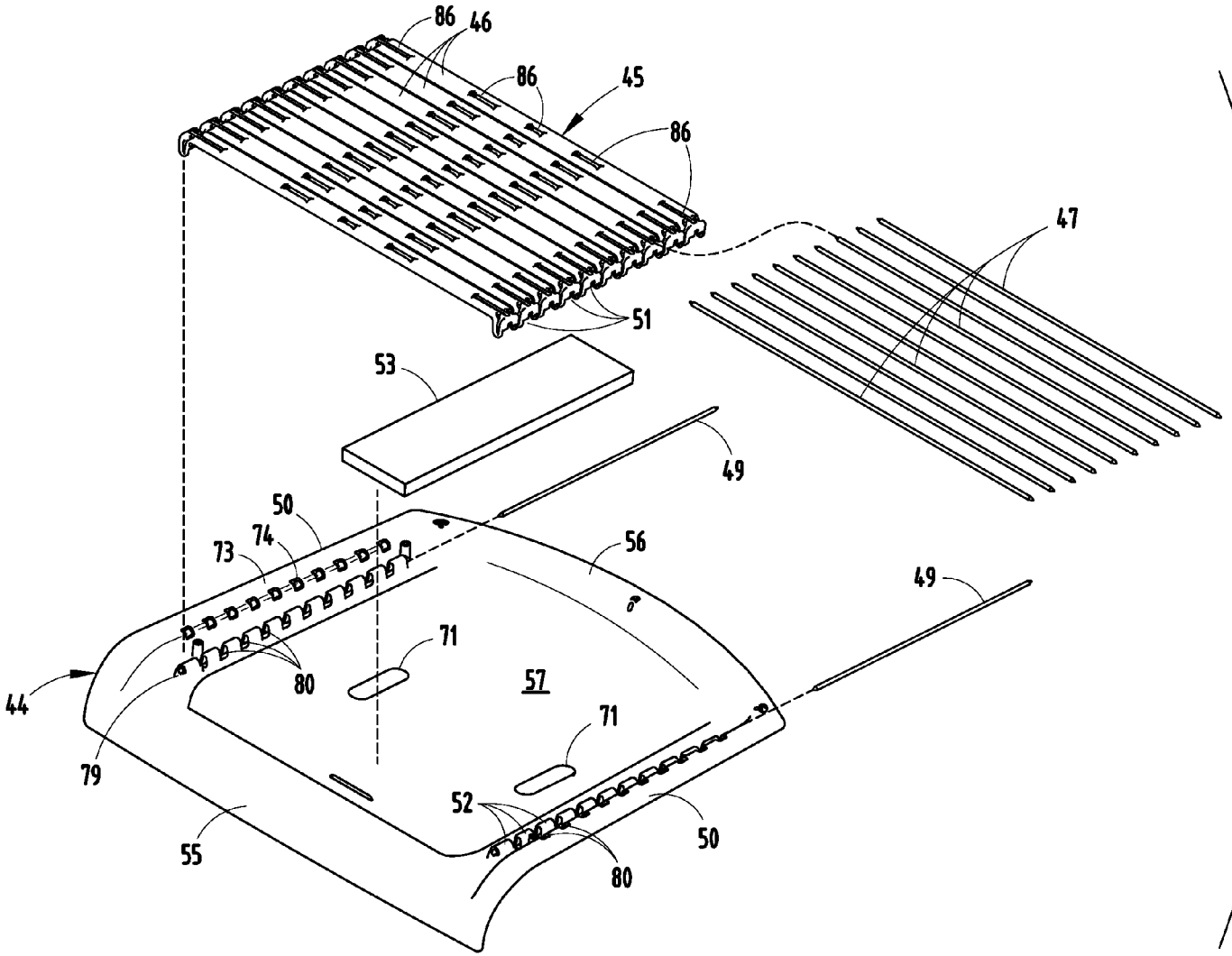
FIG. 3 is an enlarged view of the seating suspension components and seat frame from FIG. 2.
Figure 10:
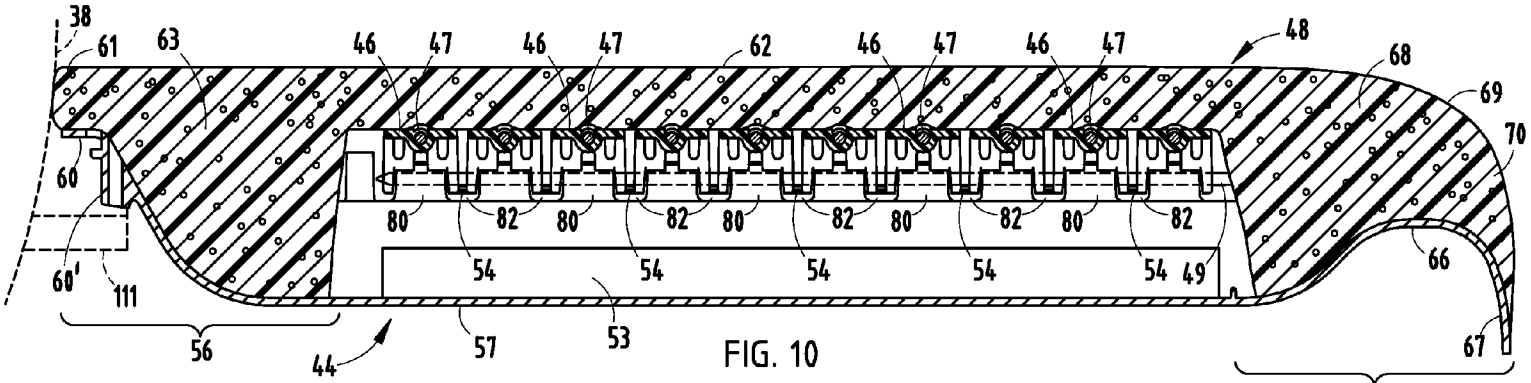
FIG. 10 is a view taken along line X-X, but extends completely across a center of the seating suspension and is taken without a person sitting on the seating suspension.

The molded frame 44 (FIG. 3) includes a perimeter frame formed by the side sections 50 and the front and rear sections 55 and 56. A floor panel 57 extends between the sections 50, 55-56, with the sections 50, 55-56 rising above the panel 57 to form a dished or pan-shaped arrangement (FIG. 10). The rear section 56 (FIG. 10) includes an outer flange 60 located at a height about equal to a top of the slats 46, and is spaced rearward of the rearmost slat 46. A boss 60' is configured to receive a screw for positive attachment of the back 33 to the seat frame 44. The cushion 48 includes a portion 61 resting on the outer flange 60, a transversely-positioned central portion 62 of about equal thickness resting on the slats 46, and a rear portion 63 above rear section 56. The rear portion 63 of the cushion 48 fills the area behind the rear-most slat 46 down to the floor panel 57.

The front section 55 (FIG. 10) includes an outer flange 66 located at a height about equal to half of the vertical distance from the floor panel 57 to a top of the slats 46, such as slightly greater than about ½ inch, and is spaced forward of the front-most slat 46. Further, the outer flange 66 extends forwardly and downwardly to form a "waterfall" shaped front edge 67. A front portion 68 of the cushion 48 fills the area in front of the front-most slat 46 down to the floor panel 57. The upper surface 69 of the front portion 68 of the illustrated cushion 48 extends at a same height as the central portion 62 and then angles forwardly and downwardly to generally match the curvature of water flowing over a waterfall. The front edge 70 of the cushion 48 tapers to a thin cross section and then ends as the front edge 67 of the front outer flange 66 turns downwardly toward a vertical direction. It is contemplated that the front portion of the molded frame 44 and cushion 48 can be different shapes, but the present arrangement has proved particularly comfortable, since the forces supporting the legs of a seated user are well distributed, such that the seated user cannot feel a sharp line where the front-most slat 46 is located and where the molded frame 44 begins. Notably, the floor panel 57 has two large apertures 71 therein (FIG. 3), the primary purpose of which is to provide visual and physical access to the area under the seat suspension and above the floor panel 57. The flex-limiting member 53 is positioned on the floor panel 57 between the apertures 71, and has a thickness sufficient to abut a bottom of the slats 46 when the slats 46 are flexed to a maximum position (see FIG. 11). Since the flex-limiting member 53 is a stiff cushion, it provides a soft stop for limiting maximum flex. It is contemplated that the flex-limiting member could be made of several different materials, and that it could be made to be adjustable in order to provide different maximum depth positions on the seating unit 30. It is noted that the flex-limiting member 53 defines a distance of flexure for the slats 46 that is about equal to the distance from the rearwardly-facing edge of the front section 55 to a top of the slats 46 when the slats 46 (and resilient supports 47) are not flexed.

Notably, the cushion 48 has a non-uniform thickness, with a rear portion supported on the support structure (i.e., slats 46 and resilient supports 47) and a cushion front portion supported on the front frame section 55 adjacent the rearwardly-facing edge. The rear portion of the cushion combines with a front of the resilient support structure to provide a force-versus-deflection curve comparable to the force-versus-deflection curve provided by a combination of the cushion front portion and the front frame section, such that a seated user does not sense any sudden change in supportive force across the rearwardly-facing edge.

The side sections 50 (FIGS. 2-3) have a multi-tiered shape, including an outer flange 73 configured to rest on side members of the U-shaped horizontal seat-supporting frame member 36 of the tubular frame 34, with a top of the outer flange 73 being about equal in height to (or angled slightly upwardly and outwardly from) a top surface of the slats 46. The outer flange 73 may include apertures 74 (FIG. 3A) permitting a tool to extend through the aperture 74 for forming a resilient leg 75. This apertured arrangement eliminates a blind surface, which would require a slide or moving part in the molding die for making the blind surface on the molded frame 44. Notably, the molded frame 44 does not have any blind surfaces, such that it can be made with a molding die without slides. Apertured bosses 76 (FIG. 3A) are located inboard of the apertures 74, and are positioned to receive a screw for engaging the inward flange 77 (FIG. 2) on the side legs of the U-shaped frame member 36, for attaching the molded frame 44 to the base 31. The legs 75 hold a tensioned drawstring of an upholstery cover as disclosed in co-assigned, co-pending application Ser. No. 11/711,346, filed Feb. 27, 2007, entitled "SEATING UNIT WITH ADJUSTABLE COMPONENT," the disclosure of which is incorporated herein by reference in its entirety.

Figure 4:
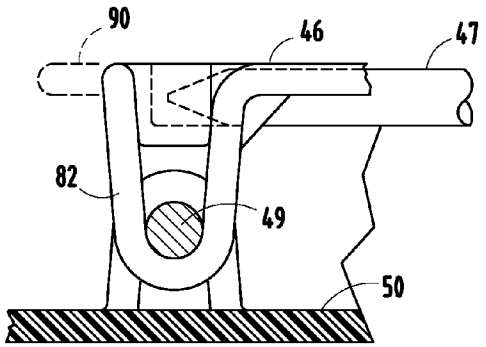
FIGS. 4-5 are views taken along line IV-IV and line V-V in FIG. 3A.
Figure 6:
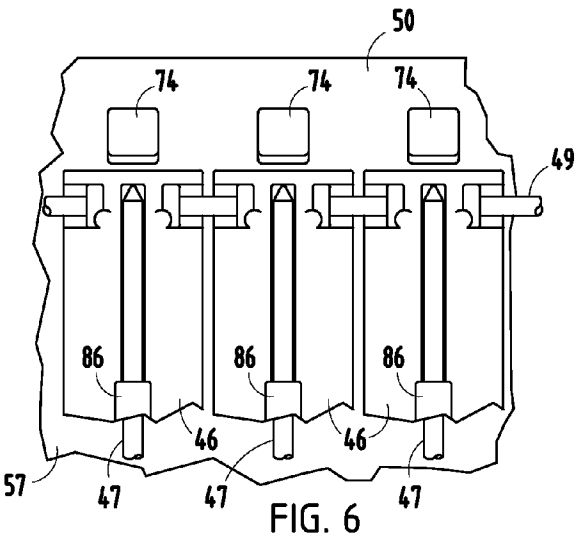
FIG. 6 is a fragmentary top view of FIG. 3A.
Figure 8:
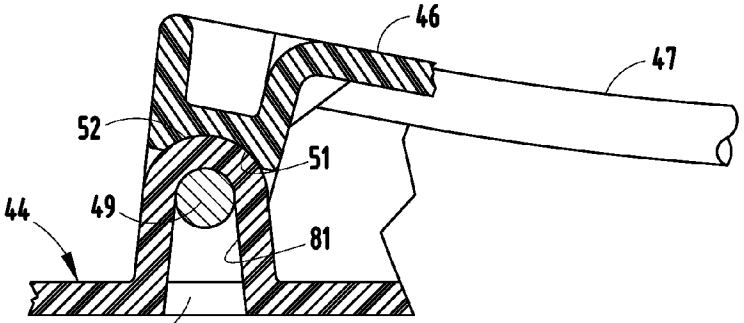
FIG. 8 is a view similar to FIG. 7, but with the slats stressed and supporting a seated user.
Figure 7:
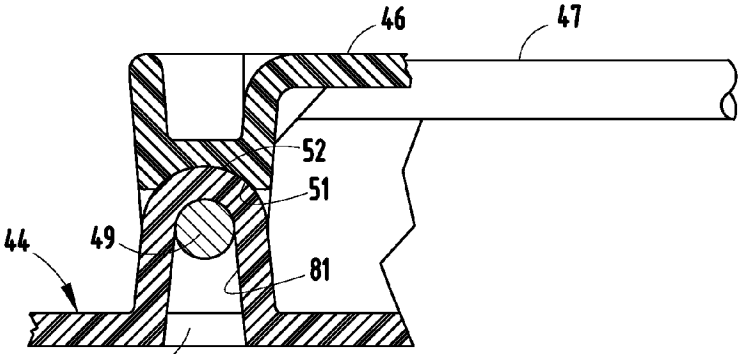
FIG. 7 is a view taken along the line VII-VII in FIG. 3A with the slats in an unstressed state.

A second flange 79 (FIG. 3) is located inward of the outer flange 73 at a location lower than the outer flange 73. The second flange 79 includes a series of spaced-apart loop structures 80 integrally formed along its length, one for each slat 46. The loop structures 80 include a top section with radiused bearing surface that forms the bearing structure 52 for slidably rotatingly engaging the bearing surface 51 on the ends of the slats 46 (FIGS. 7-8). The loop structures 80 further include a bottom surface 81 (FIG. 7) defining a downwardly-facing retainer loop that defines with other parts of the molded frame a laterally-extending hole for capturing the connecting rods 49 (See also FIGS. 3A, 4, and 6A). The ends of the slats 46 (FIG. 4) include a pair of loop structures 82 on opposite front and rear sides of the bearing surfaces 52 that straddle the loop structures 80. The slat loop structures 82 vertically overlap the molded frame loop structures 80 and form retainers each having a laterally-extending hole. With the loop structures 80 and 82 overlapping and their laterally-extending holes aligned, the connecting rods 49 can be extended parallel the side sections 50 through the holes in the loop structures 80 and 82, such that each end of the slats 46 are rotatably retained to the molded frame 44. This provides an exceptionally quick assembly with minimal separate parts and yet provides positive smooth rotatable support for each of the slats. Notably, there is an aperture 83 (FIG. 7) under each loop structure 80 such that the loop structures 80 do not form a blind surface, and hence can be molded into the molded frame 44 using a molding die that does not have to include slides in this area of the part.

Figure 5:
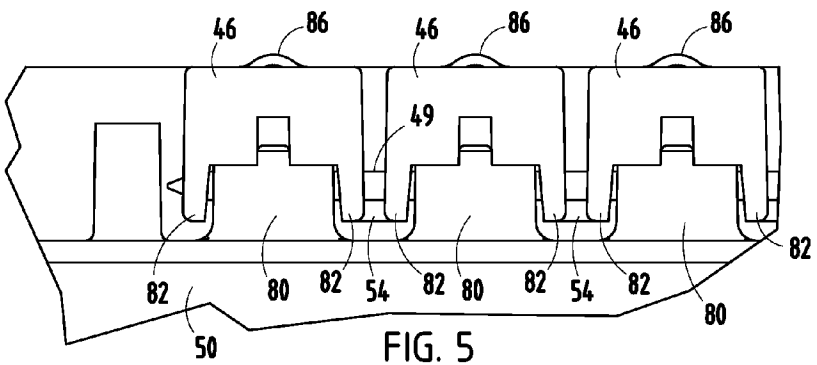
Figure 6A:
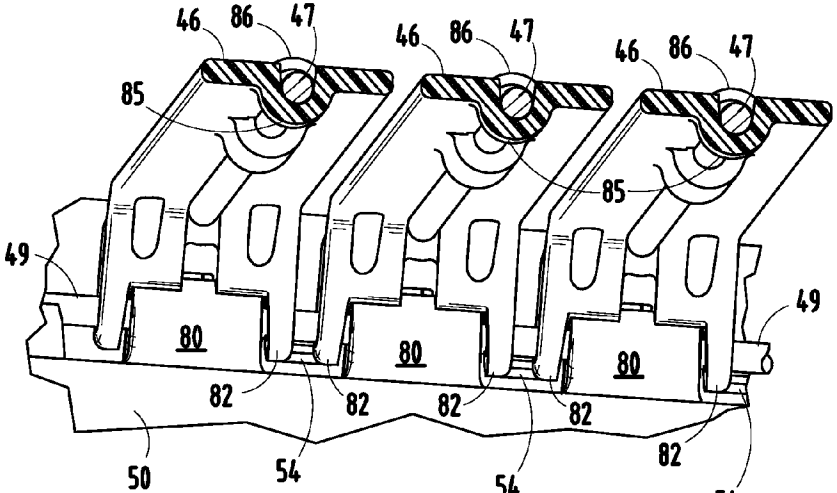

As molded, the one-piece molded component 45 includes a plurality of slats 46 (FIG. 3, ten shown), which are interconnected by tabs 54 (FIGS. 5 and 6A). The illustrated tabs 54 extend between the slats 46 (i.e., between the loop structures 82 of adjacent slats 46). The illustrated tabs 54 are relatively short and "stubby," and are located and shaped to fracture and break when the slats 46 are flexed in a manner causing the loop structures 82 to rotate relative to each other. (Compare FIG. 7 to FIG. 8.) Thus, the one-piece molded component 45 can be molded as a unit and then handled as a unit when placing it on a base 31 and when installing the connecting rods 49. The slats 46 can then be separated by flexing them one at a time, causing the tabs 54 to break due to the relative movement. This can be done during assembly, or potentially when a person first sits on the chair. Notably, in an alternate version, the tabs 54 can be made flexible so that they do not break. This is done by making them sufficiently flexible to bend as individual slats 46 are flexed. For example, this can be done by providing the tabs with a cross section that is sufficiently thin in the direction of flexure, such that the tabs flex instead of breaking. Alternatively, flexible tabs can be formed by making the tabs to have a "U" shape or "S" shape lying in a horizontal plane, where the tabs extend from a first loop structure 82 to a next loop structure 82 or where the tabs extend between the slats 46 and lie in the upper horizontal plane of the slats 46.

Figure 11:
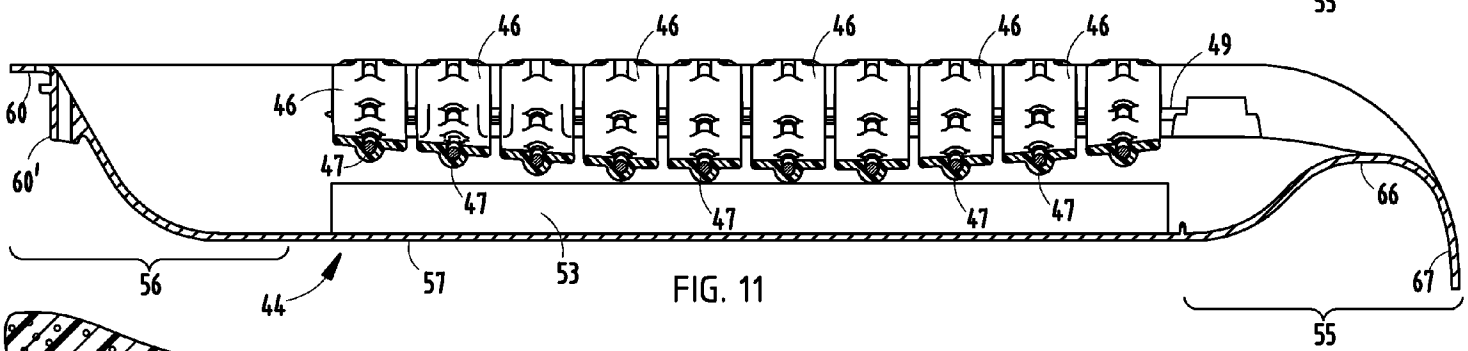
FIG. 11 is a view similar to FIG. 10, but with a person sitting on the seating suspension and with the cushion removed to better show the slats.
Figure 12:
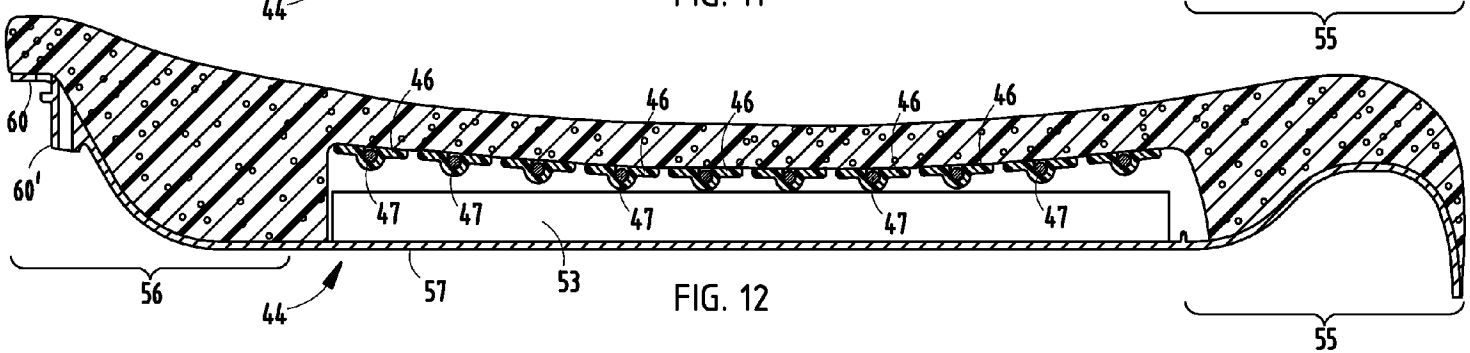
FIG. 12 is similar to FIG. 11, with the cushion and seat suspension shown as compressed by a person sitting thereon.

The slats 46 (FIG. 6A) each include a strip that extends across the molded frame 44. The slats 46 have a transverse cross section with a width dimension (i.e., about one inch) that is about 10 times its height dimension. The width is selected to allow the slats to distribute force from a seated user. Each slat 46 has a plurality of retainer loops 85 formed along their lengths under slots 86. The slots 86 permit the loops 85 to be formed without blind surfaces in the molded frame 44. A channel is formed along the bottom surface of each slat 46 in alignment with the hole in the loops 85. The illustrated resilient supports 47 are resilient wire rods that can be slipped through the loops 85 and along the channels under the slats 46. Thus, the resilient supports 47 are closely retained to the slats 46 for flexing with the slats as a unit when the slats 46 are flexed, such as when a user sits in the seating unit 30. However, the slats 46 are able to twist slightly in a fore-aft direction to continuously be in alignment with adjacent slats 46, as shown in FIG. 11. The present arrangement with one resilient support 47 with each slat 46 is preferred, but it is noted that more than one resilient support 47 can be used on each slat 46, if desired.

The cushion 48 (FIG. 2) is upholstered or otherwise finished as desired. It is contemplated that the cushion 48 can be held in position by different means, such as by adhesive material bonding it to a perimeter of the molded frame 44. Alternatively, the front (or rear) edge of the cushion 48 can be hook attached to a front (or rear) lip of the molded frame 44, and the opposite edge of the cushion can be attached by wrapping it onto a bottom of the molded frame 44 and hooking, stapling, adhering, or otherwise securing it in place.

Figure 9:
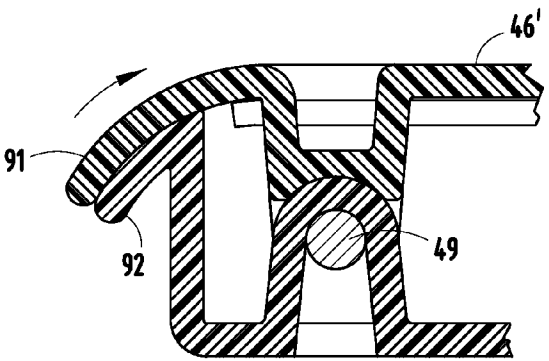
FIG. 9 is a view similar to FIG. 7, but with a modified slat having an outwardly extending flange.

The illustrated slats 44 (FIGS. 7-8) end at a location above the bearing surfaces 51. It is noted that if the ends extended outward beyond the bearing surfaces 51 (see end 90 represented by dashed lines in FIG. 4), then the ends would tend to lift when the slats 46 were flexed. This is not a problem for several reasons. First, even if the slats 46 terminate as shown by end 90, the upward movement is minimal. Also, the movement is at an edge of the seat, such that a seated user's body shape is normally rounded up at that outermost location. Nonetheless, with some chair designs, this upward movement may be significant. For this purpose, the alternative end 91 (FIG. 9) is shown. The end 91 is curved outward and downward to match a corresponding shape of the outer flange 92 of the illustrated molded frame. The curve of end 91 defines a center axis located basically at connecting rod 49. Thus, when a particular slat 46' (FIG. 9) is flexed downward (such as when a person sits on it), the end 91 merely slides inwardly along the outer flange 92, moving along an arc having its axis of rotation substantially at the connecting rod 49.

Figure 13A:
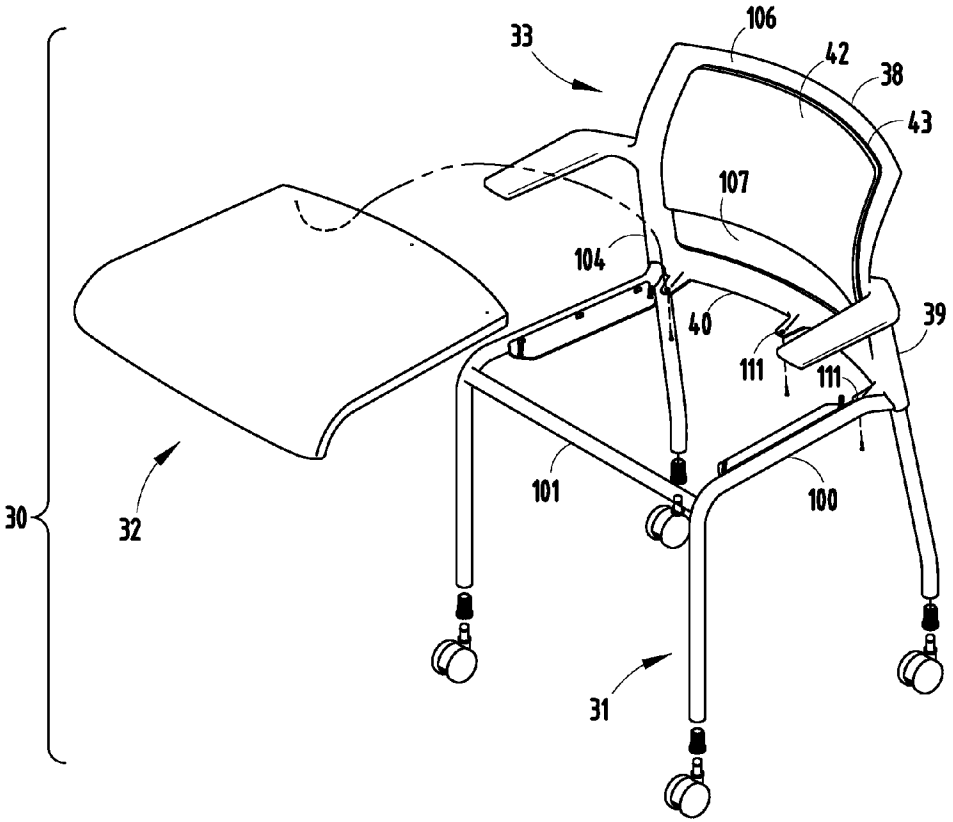
FIGS. 13-13A are perspective views showing assembly of a back with arms to a base (FIG. 13) and a seat to the back-and-base subassembly (FIG. 13A).
Figure 13:
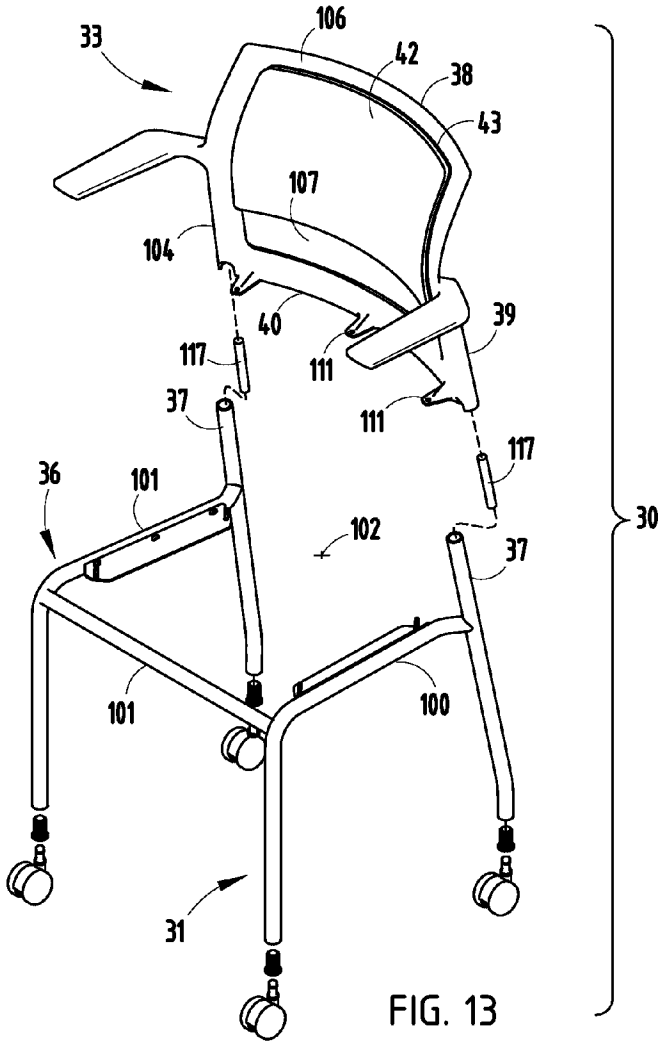

As shown in FIG. 13, the seating unit 30 includes a base frame 31 having a U-shaped horizontal frame member 36 formed by side sections 100 and front transverse section 101 and that is adapted to support a seat suspension 32 (also called a "seat" herein). Notably, the illustrated rear portions of frame member 36 are not connected by any structural cross member, such that there is a rearwardly-facing open area 102 between the rear portions. The base frame 31 further includes a pair of protruding uprights 37 at a rear of the side sections 100. The molded back component 38 with arms has corner sections 39 with downwardly-open cavities shaped to closely and matably telescopingly engage the uprights 37. Notably, the back component 38A is very similar to back component 38, but does not include armrests. Accordingly, only the back component 38 will be described below, with the back component 38A being sufficiently similar for an understanding by persons skilled in the art of chair design.

Figure 16:
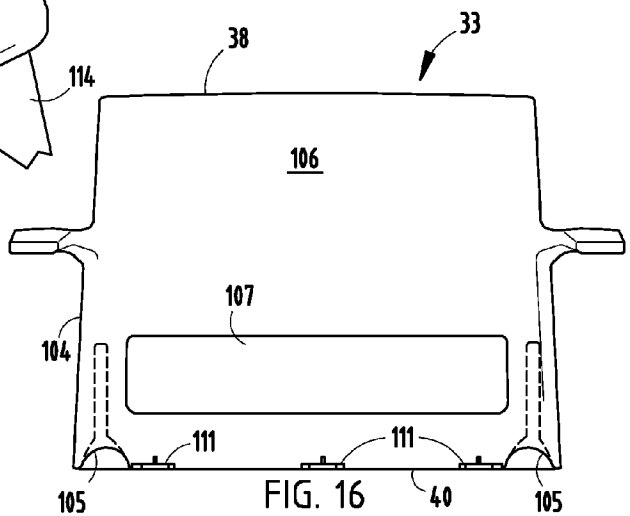
FIG. 16 is a front view of the back.

As noted above, the back component 38 has an enlarged horizontal beam section 40 extending between the corner sections 39 with the beam section 40 being sufficiently rigid and longitudinally stiff such that it is configured to stabilize the rear portions of the side sections 100 of frame 36 when the molded back 38 is engaging the uprights 37. The illustrated beam section 40 has a downwardly open U-shaped cross section and may or may not include perpendicular or diagonal cross ribs for torsionally stiffening the beam section. The corner sections 39 extend upwardly from ends of the cross beam section 40 and are integrally connected in a manner such that the beam section 40 rigidly interconnects the corner sections 39 and hence also rigidly interconnects the uprights 37 thus in turn rigidifying a rear of the frame member 36 in a manner stabilizing the entire frame 31. It is noted that a front of the corner sections 39 at ends of the beam section 40 includes U-shaped notch formations 105 (FIG. 16) that abut and engage a top of the side sections 100 for accurately setting a downward engagement of the corner sections 39 on the uprights 37 and for locating the back 38 accurately on the frame 31.

The back 38 (FIG. 13) includes an upper back panel 106 that extends between top portions of the corner sections 39, and its lower edge defines a window or aperture 107 with a top of the beam section 40. The upper back panel 106 is semi-rigid but is sufficiently resilient and thin to allow limited flexure and movement to ergonomically support a seated user. Also, there is a cushion assembly formed by upholstered cushion 42 and the panel structure 43 attached to the upper back panel 106, as discussed below. The upholstered cushion and panel structure of the back 38A are generally very similar to the components 42 and 43 discussed above, except modified along their edges to be shaped for the armless version of back component 38A. A plurality of tabs 111 (three being illustrated) extend forward of the beam section 40, at a location under the seat 32 (FIG. 13A). They include holes for receiving attachment screws that extend through the tabs into a bottom of the seat frame 44 of the seat 32 (see FIG. 10).

Figure 15:
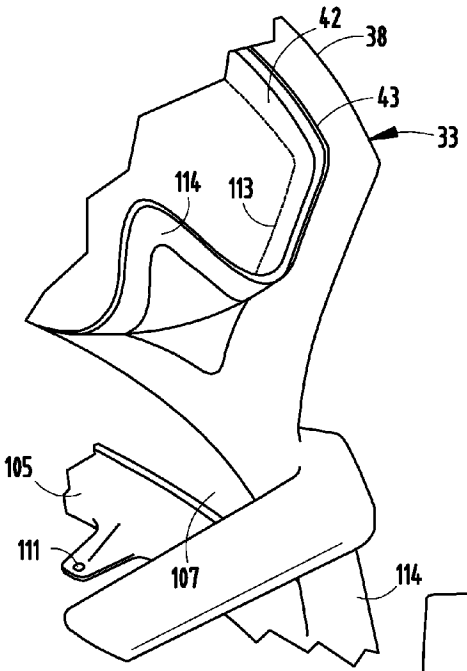
FIG. 15 a perspective view of a back component with adhered cushion and cushion-stiffening panel structure, the panel structure being torn along a perimeter perforation line with the outboard strip staying attached to the cushion and the inboard center panel attached to the back component.

The panel structure 43 (FIGS. 2 and 15) has a plurality of weakened portions along its perimeter. The illustrated weakened portions are a line of perforations 113 that extend parallel a perimeter of the panel structure completely around its perimeter, forming a marginal strip 114. The strip 114 is as small as possible, such as about ½ inch to ¾ inch in width, while still allowing sufficient surface area for bonding and allowing sufficient room for receiving the adhesive (without the adhesive spilling onto an opposite side of the perforations 113). The illustrated perforations are a series of aligned short slots or can be a line of small holes. However, it is contemplated that other structure can be designed for accomplishing a similar purpose, such as a thinned area. Also, the perforations can define a plurality of islands or peninsula-shaped pads around the perimeter of the panel structure 43, such that they form spaced apart pads around the perimeter that remain when the panel structure 43 and cushion 42 are torn away. The upholstered cushion 42 is adhered by adhesive to the panel structure 43 along its perimeter outboard of the weakened line formed by perforations 113, i.e., along strip 114. The panel structure 43 is attached to one of the seat and back components inboard of the weakened portions, such as by sprayed on adhesive or by a random pattern of adhesive lines applied to the back panel 106 at locations corresponding to inboard positions relative to the weakened areas/perforations 113. The panel structure 43 and the back component 38 are made of compatible materials that can be recycled together without separation. For example, the back component 38 can be made of a glass-filled polypropylene overcoated by a no-glass polypropylene for appearance (the no-glass polypropylene potentially being a different grade of polypropylene that is particularly adapted for good appearance). The panel structure 43 can also be made from polypropylene (though perhaps not the exact same grade as the polypropylenes used to make the back component 38).

Figure 2:
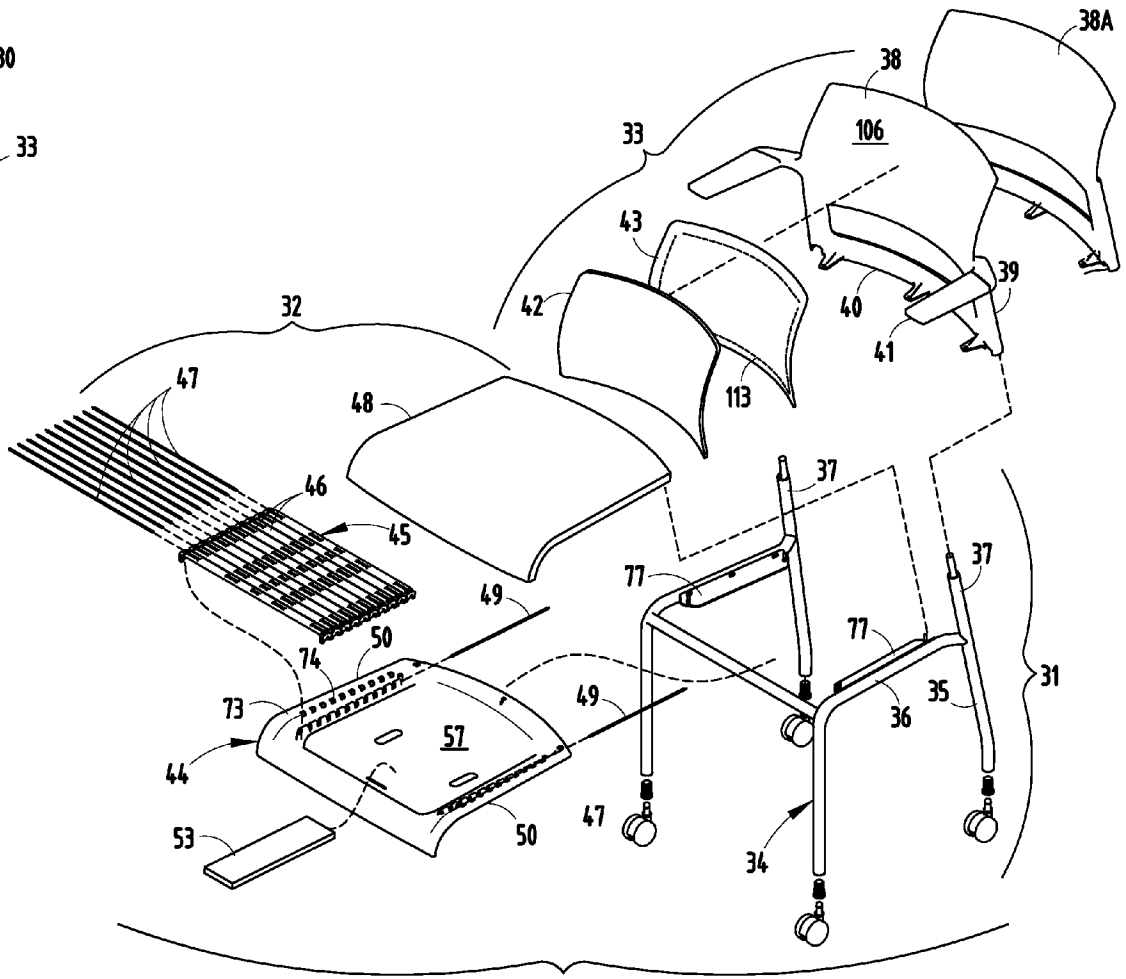
FIG. 2 is an exploded perspective view of FIG. 1.
Figure 3A:
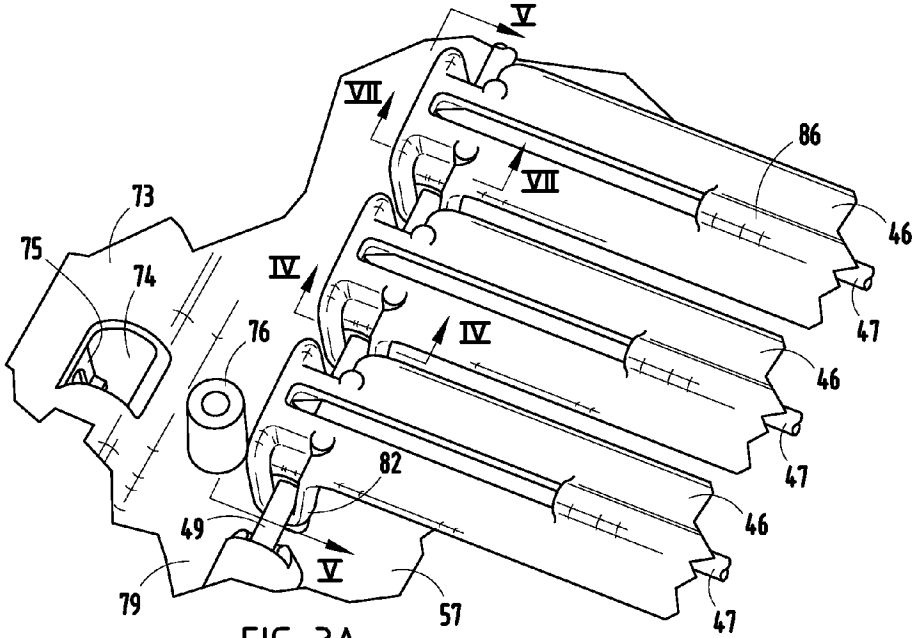
FIG. 3A is an enlarged perspective view of the attachment area along a side section of the seat frame, showing an assembly of components from FIG. 2.
Figure 14:
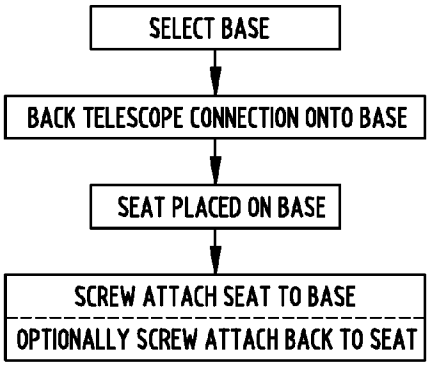
FIGS. 14-14A are flow charts showing a method of assembly (FIG. 14) and disassembly for recycling (FIG. 14A).
Figure 14A:
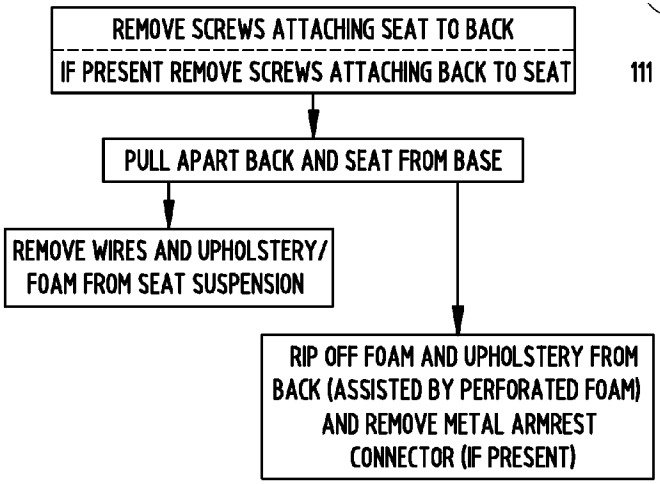

By this arrangement, the upholstered cushion 42 can be separated from remaining parts of the back 38 by pulling on a corner of the cushion assembly (see FIG. 14A and also the perspective view in FIG. 15) tearing along the weakened perforation lines 113. A majority of the panel structure 43 stays attached to the back component 38 and is recyclable therewith. The upholstery and cushion (42) are often made from materials that are not recyclable, and by this arrangement can be readily removed for proper disposal. For example, customer-selected upholstery is often not recyclable, and also traditional cushions made from polyurethane foam are also not recyclable. Thus, the present arrangement saves tremendous time when trying to recycle parts from worn chairs thus leading to significant value to customers concerned with recycling. It is noted that the seat suspension 32 is also made to be readily separated into recyclable components, as shown in FIG. 2 and flow chart FIG. 14A, such that it also meets high/stringent standards for recycle-ability.

It is contemplated that the uprights 37 can be made in various ways. For example, the uprights 37 can be made longer (or shorter) depending on functional requirements of the chair. Also, the uprights 37 (which are tubular) can be reshaped and formed as desired.

Figure 19:
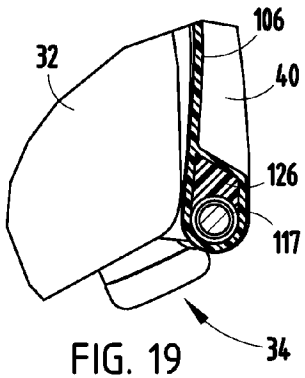
FIG. 19 is a cross-sectional view taken along line XIX in FIG. 18.
Figure 17:
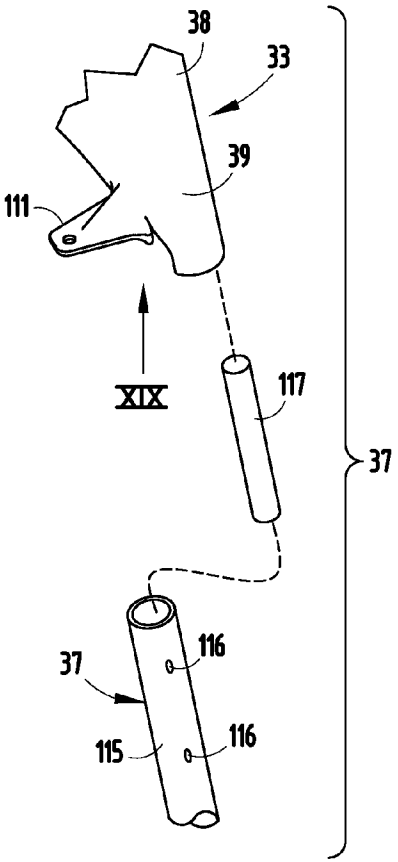
FIG. 17 is an exploded view of the upright and corner section of the back component.
Figures 20, 21, 22, 23, 24:
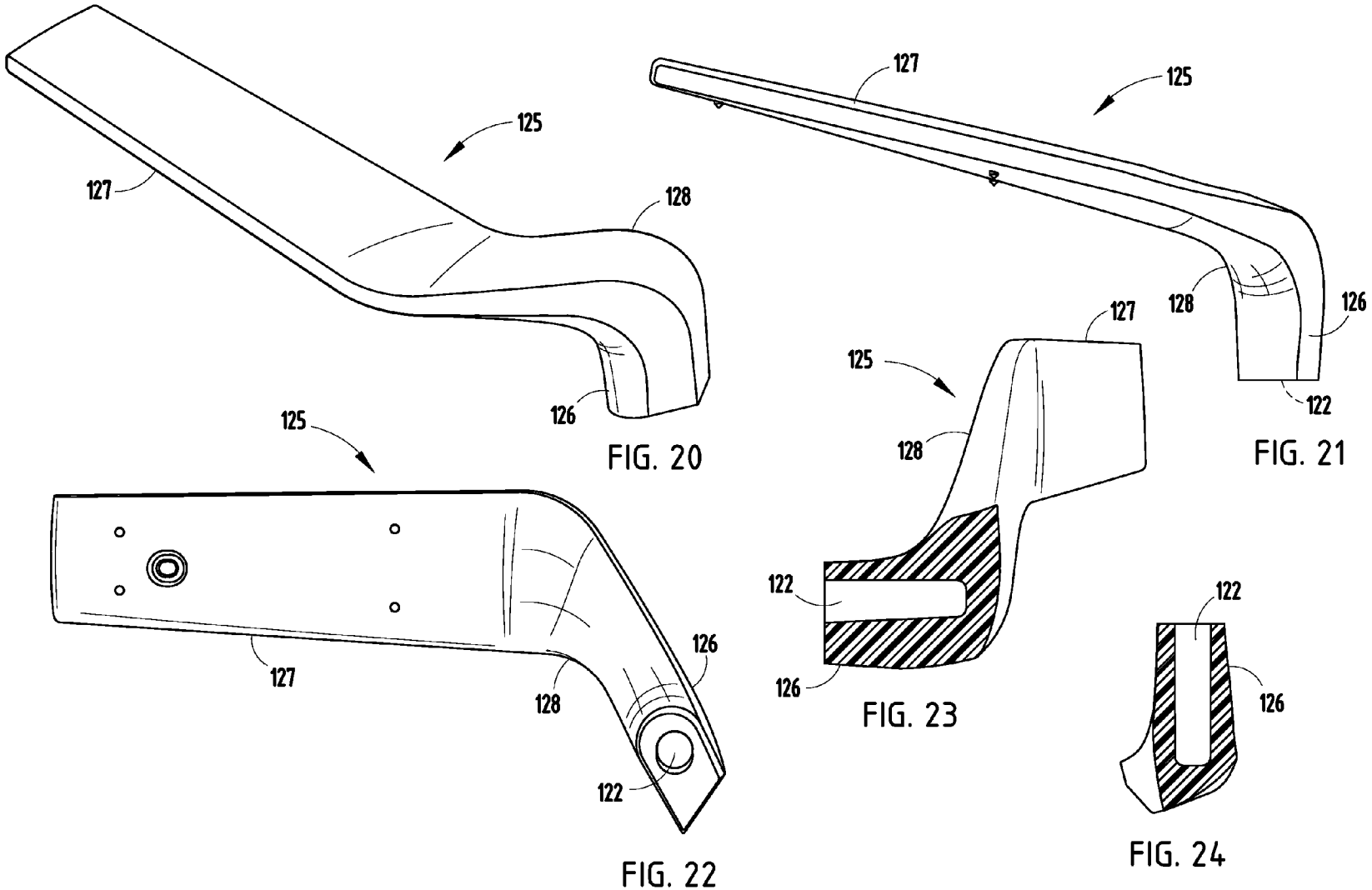
FIGS. 20-22 are perspective, side, and bottom views of a glass-filled molded component that is insert-molded into the back of FIG. 1.
FIGS. 23-24 are cross-sectional views taken along the lines XXII-XXII and XXIII-XXIII in FIG. 22.

The illustrated arrangement of uprights 37 (FIG. 17) includes a tubular lower portion 115, with a pair of apertures 116, and a solid rod extension 117 welded to the tubular lower portion 115 through the apertures 116 to form an upper portion. This has the advantage of providing an equally rigid upper portion on the upright 37, while still providing a reduced cross section near its top for engaging the corner sections 39. This allows the corner sections 39 to potentially have a smaller cross-sectional size near its top (i.e., hole-forming surface 122), while still having sufficient structure and plastic material at the corner section 39 to support the armrests 41 of back component 38 and/or to support the armless back component 38A. The corner sections 39 include a lower region (FIG. 19) shaped to closely engage the tubular portion of the upright 37, and a smaller diameter upper region (i.e. hole-forming surface 122) shaped to closely engage the rod 117 of the upright 37. Alternatively, it is contemplated that, in some chair designs, only one of the upper and lower regions will closely engage the mating portion of the upright. Alternatively, it is contemplated that only a side of one (or both) of the upper and lower regions will engage the upright, depending on the torsional functional requirements of the chair back design.

Figure 18:
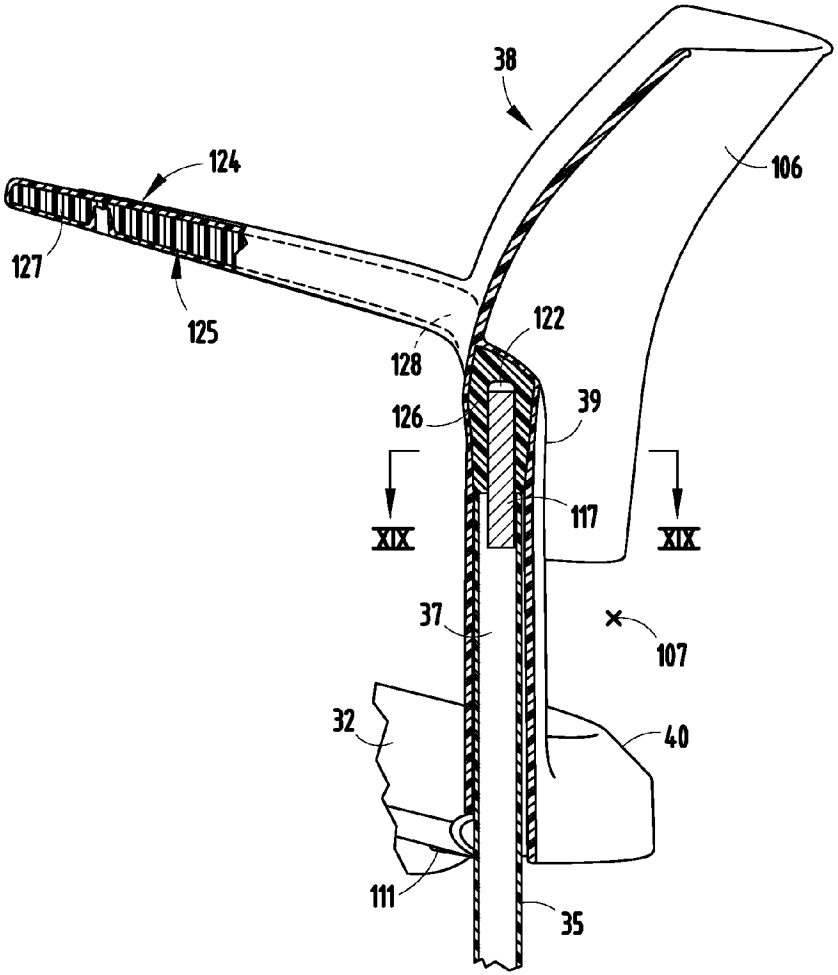
FIG. 18 is a cross section taken vertically through a corner section of the back component.

The preferred back 38 (FIG. 18) is a molded part including right and left glass-reinforced polypropylene reinforcing parts 125 forming each armrest 124 and with an overmolding of no-glass polypropylene for aesthetics and for increased flexibility in the upper back panel 106 of the back 38. By molding the back 38 of glass filled polypropylene overmolded with no-glass polypropylene, the back 38 can be reground and recycled. It is noted that other polymeric materials could also be used in place of the glass filled polypropylene and in place of the no-glass polypropylene without departing from the present concepts. These materials can be selected to be sufficiently compatible to be reground together or can be selected for their properties alone. In a preferred version, the two reinforcing parts 125 (FIGS. 20-25) each include a base portion 126 forming an internal part of the corner sections 39, an armrest extension portion 127 forming an internal part of the associated armrest 41, and a connecting portion 128 that positions the extension portion 127 relative to the base portion 126. The base portion 126 includes the hole-forming surface 122 for receiving the rod extension 117. When the back 38 is molded, the no-glass polypropylene includes a skin 129 covering the armrest extension portion 127, a skin 130 covering the base portion 126, and further includes material forming the beam section 40, the back panel 106, and a remainder of the back 38. It is contemplated that the reinforcing parts 125 may also include portions forming part of the beam 40. Alternatively, it is contemplated that the parts 125 may be formed as part of a single unitary component with portions forming the entire beam 40, both the corner sections 39, the armrests 41 and parts of the back panel 106. Notably, the illustrated rod 117 and hole surface 122 closely engage, but it is contemplated that the rod 117 may be smaller in diameter than the upper hole surface 122, and may engage the upper region 122 only along an inboard corner of the hole such as at a 45° angle when viewed from above (see FIG. 19). For example, this arrangement could be used for the armless back 38A, where torsional stress on the corner section is reduced due to elimination of the armrest.

The present chair 30 (with armrests 41 or without) is configured to be stacked. For example, the rear legs 35 fit between the armrests 41 and an outside of the seat 32. Each successive stacked chair is positioned slightly forward and above the underlying chair unless a tilting storage cart is provided. The present chairs 30 can be stacked about four to five chairs high without the need for a tilted storage cart.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A seating construction comprising:

a frame defining an open area and including a plurality of discrete first structures positioned along opposite sides of the open area, said plurality of first structures being spaced apart to form gaps therebetween;

a plurality of elongated flexible slats extending across the frame between the opposite sides and over the open area, each slat having ends with second structures thereon, each said second structure being configured to align with a selected one of said first structures and including protruding portions which extend into the gaps on either side of the selected one of the first structures;

said first structures and the protruding portions of the second structures include passages that at least partially align; and a connector being positioned in the aligned portion of the passages to secure the first structures and protruding portions in position.

2. The seating construction defined in claim 1, including a plurality of resilient wires extending across the open area and supported by the slats.

3. The seating construction defined in claim 2, wherein at least one of the resilient wires is coupled to each of the slats.

4. The seating construction defined in claim 1, including tabs integral with and interconnecting adjacent ones of the slats, the tabs being flexible and deformable and positioned to deform when individual ones of the slats are flexed.

5. The seating construction defined in claim 1, wherein the first and second structures are integrally formed on the frame and the slats, respectively.

6. The seating construction defined in claim 1, including a cushion on several of the slats.

7. The seating construction defined in claim 1, including a flex limiting member positioned under at least some of the slats for limiting deformation of the slats to a maximum deflected position.

8. The seating construction defined in claim 1, wherein the frame includes a floor panel and perimeter supporting sections that define with the opposite sides a pan shape.

9. The seating construction defined in claim 8, including a flex limiting member positioned between the floor panel and at least some of the slats.

10. The seating construction defined in claim 1, wherein the frame and the plurality of slats are each molded recyclable polymer.

11. The seating unit defined in claim 1, including tabs integral with and interconnecting adjacent ones of the slats, the tabs being flexible and deformable and positioned to deform when individual ones of the slats are flexed.

12. A seating unit comprising:

a base supporting a frame;

the frame defining an open area and including a plurality of discrete first structures positioned along opposite sides of the open area, said plurality of first structures spaced apart to form gaps therebetween;

a plurality of elongated flexible slats extending across the frame between the opposite sides and over the open area, each slat having ends with second structures thereon, each said second structure being configured to align with a selected one of said first structures and including protruding portions which extend into the gaps on either side of the selected one of the first structures;

said first structures and the protruding portions of the second structures include passages that at least partially align; and a connector being positioned in the aligned portion of the passages to secure the first structures and protruding portions in position.

13. The seating unit defined in claim 12, wherein the frame includes a floor panel and perimeter supporting sections that define with the opposite sides a pan shape and wherein a flex-limiting member is positioned in the open area between the floor panel and the resilient supports, the flex-limiting member shaped to simultaneously engage several of the resilient supports to limit movement of the resilient supports to a maximum deflected condition.

14. The seating unit defined in claim 12, including a plurality of resilient wires extending across the open area and supported by the slats.

15. The seating unit defined in claim 14, wherein at least one of the resilient wires is coupled to each of the slats.

16. The seating unit defined in claim 12, wherein the frame and the first structures are a unitary construction and each said slat and its respective said second structures are a unitary construction.

17. The seating unit defined in claim 12, including a cover positioned over the resilient supports.

18. The seating unit defined in claim 17, further including a cushion positioned between the resilient supports and the cover.

* * * * *